United States Patent [19]

Pelton

[11] 4,373,704

[45] Feb. 15, 1983

[54] APPARATUS FOR REFINING MOLTEN METAL

[75] Inventor: John F. Pelton, Yorktown Heights, N.Y.

[73] Assignee: Union Carbide Corporation, Danbury, Conn.

[21] Appl. No.: 158,771

[22] Filed: Jun. 12, 1980

[51] Int. Cl.[3] ..... C22B 21/06

[52] U.S. Cl. ..... 266/225; 266/230; 75/68 R

[58] Field of Search ..... 266/225, 229, 230; 75/68 R, 93 R

[56] References Cited

U.S. PATENT DOCUMENTS 2,968,847 1/1961 Bergmann ..... 266/229
3,743,263 7/1973 Szekely ..... 75/68 X

FOREIGN PATENT DOCUMENTS 1252741 11/1971 United Kingdom ..... 75/68

*Primary Examiner*—G. Peters
*Attorney, Agent, or Firm*—Saul R. Bresch

[57] ABSTRACT

In an apparatus for refining molten metal comprising, in combination:

(a) a vessel having an inlet zone and an outlet zone; at least two refining compartments in between, connected in series, separated by baffles, and positioned in such a manner that the first refining compartment in the series is adjacent and connected to the inlet zone and the last refining compartment in the series is adjacent and connected to the outlet zone; and dross removal means; and (b) one rotating gas distributing device disposed at about the center of each refining compartment, said device comprising a shaft having drive means at its upper end and a rotor fixedly attached to its lower end, the upper end being positioned in the top section of the compartment and the lower end being positioned in the bottom section of the compartment, the improvement comprising:

1. positioning the inlet zone and the outlet zone in such a manner that the molten metal is permitted to flow from the bottom of the inlet zone to the bottom section of the first refining compartment in the series and from the top section of the last refining compartment in the series to the top of the outlet zone; and
2. utilizing for each separating baffle, a baffle consisting of first and second baffles bearing a spaced relationship to one another and positioned in such a manner that (i) the first baffle is on the inlet side of the vessel and the second baffle is on the outlet side of the vessel and (ii) molten metal is permitted to flow from the top section of one refining compartment over the top of the first baffle into the space between the first and second baffles and under the second baffle into the bottom section of the next refining compartment in the series.

6 Claims, 5 Drawing Figures

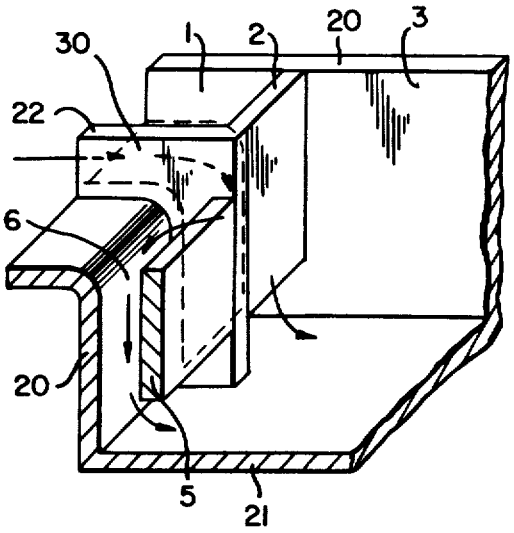
FIG. 3
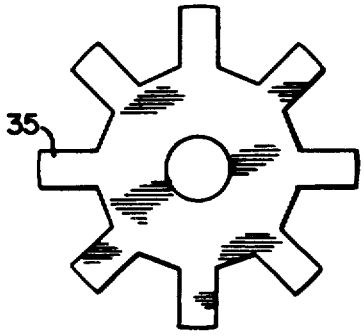
FIG. 5
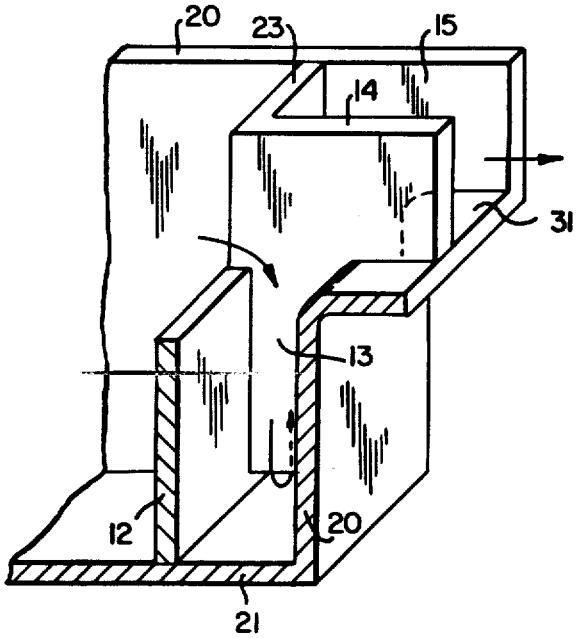

APPARATUS FOR REFINING MOLTEN METAL

FIELD OF THE INVENTION

This invention relates to apparatus for refining molten metal.

Description of the Prior Art

Although the invention described herein has general application in refining molten metals, it is particularly relevant in refining aluminum, magnesium, copper, zinc, tin, lead, and their alloys and is considered to be an improvement over the apparatus described in U.S. Pat. No. 3,743,263 issued July 3, 1973, which is incorporated by reference herein.

Basically, the process carried out in the reference apparatus involves the dispersion of a sparging gas in the form of extremely small gas bubbles throughout a melt. Hydrogen is removed from the melt by desorption into the gas bubbles, while other non-metallic impurities are lifted into a dross layer by flotation. The dispersion of the sparging gas is accomplished by the use of rotating gas distributors, which produce a high amount of turbulence within the melt. The turbulence causes the small non-metallic particles to agglomerate into large particle aggregates which are floated to the melt surface by the gas bubbles. This turbulence in the metal also assures thorough mixing of the sparging gas with the melt and keeps the interior of the vessel free from deposits and oxide buildups. Non-metallic impurities floated out of the metal are withdrawn from the system with the dross while the hydrogen desorbed from the metal leaves the system with the spent sparging gas.

The system in which this process is carried out and which is of interest here is one in which the metal to be refined flows through an entrance compartment (or trough) into a first refining compartment, over a baffle, and into a second refining compartment, each of the compartments having its own rotating gas distributor. The molten metal then enters an exit tube and passes into an exit compartment, which for the sake of efficient utilization of space is along side of the entrance compartment at the same end of the refining apparatus. See FIGS. 4 and 5 of U.S. Pat. No. 3,743,263, mentioned above. The compact nature of this arrangement results, advantageously, in a relatively small sized piece of equipment.

While the compact system has performed, and continues to perform, well in service, it has a maximum refining capacitiy of 60,000 pounds of metal per hour. Many plants, however, have a need for an even higher refining rate, but do not have the space to accommodate a scale-up of the existing system, e.g., a three refining compartment/three rotating gas distributor system. Other plants that have additional space are seeking greater refining capacity for each of the refining compartments in their system.

SUMMARY OF THE INVENTION

An object of this invention, therefore, is to provide an improvement in existing refining apparatus which is capable of increasing the refining capacity of the apparatus with a modest increase in size or providing greater refining capacity per refining compartment.

Other objects and advantages will become apparent hereinafter.

According to the present invention, such an improvement has been discovered in known apparatus for refining molten metal comprising, in combination:

(a) a vessel having an inlet zone and an outlet zone; at least two refining compartments in between, connected in series, separated by baffles, and positioned in such a manner that the first refining compartment in the series is adjacent and connected to the inlet zone and the last refining compartment in the series is adjacent and connected to the outlet zone; and dross removal means; and (b) one rotating gas distributing device disposed at about the center of each refining compartment, said device comprising a shaft having drive means at its upper end and a rotor fixedly attached to its lower end, the upper end being positioned in the top section of the compartment and the lower end being positioned in the bottom section of the compartment.

The improvement comprises:

1. positioning the inlet zone and the outlet zone in such a manner that the molten metal is permitted to flow from the bottom of the inlet zone to the bottom section of the first refining compartment in the series and from the top section of the last refining compartment in the series to the top of the outlet zone; and
2. utilizing for each separating baffle, a baffle consisting of first and second baffles and bearing a spaced relationship to one another and positioned in such a manner that (i) the first baffle is on the inlet side of the vessel and the second baffle is on the outlet side of the vessel and (ii) molten metal is permitted to flow from the top section of one refining compartment over the top of the first baffle into the space between the first and second baffles and under the second baffle into the bottom section of the next refining compartment in the series.

The compact system is achieved by providing an apparatus for refining molten metal comprising, in combination:

(a) a vessel having six compartments: an inlet compartment, a first dross removal compartment, a first refining compartment, a second refining compartment, an outlet compartment, and a second dross removal compartment wherein the following baffles, which permit the flow of metal from one compartment to another, are present as follows: baffle (i) separating the inlet compartment from the first refining compartment; baffle (ii) separating the first refining compartment from the second refining compartment; baffle (iii) separating the second refining compartment from the second dross removal compartment; baffle (iv) separating the second dross removal compartment from the outlet compartment; and baffle (v) separating the first refining compartment from the first dross removal compartment; and (b) one rotating gas distributing device disposed at about the center of each refining compartment, said device comprising a shaft having drive means at its upper end and a rotor fixedly attached to its lower end, the upper end being positioned in the top section of the compartment and the lower end being positioned in the bottom section of the compartment, the improvement comprising positioning the baffles as follows:

baffle (i) is positioned in such a manner that that molten metal is permitted to flow from the bottom section of the inlet compartment to the bottom section of the first refining compartment;

baffle (ii) comprises first and second baffles, bearing a spaced relationship to one another, positioned in such a manner that molten metal is permitted to flow from the top section of the first refining compartment over the top of the first baffle into the space between the first and second baffles and under the second baffle into the bottom section of the second refining compartment;

baffle (iii) is positioned in such a manner that molten metal is permitted to flow from the top section of the second refining compartment to the top section of the second dross removal compartment;

baffle (iv) is positioned in such a manner that molten metal is permitted to flow from the bottom section of the second dross removal compartment to the bottom section of the outlet compartment; and baffle (v) is positioned in such a manner that the molten metal is permitted to flow from the top section of the first refining compartment into the top section of the first dross removal compartment and from the bottom section of the first dross removal compartment to the bottom section of the first refining compartment.

BRIEF DESCRIPTION OF THE DRAWING

FIG. 3 is a schematic diagram of a cross-section of the inlet end of the same embodiment, in perspective.

FIG. 4 is a schematic diagram of a cross-section of the outlet end of the same embodiment, also in perspective.

FIG. 5 is a schematic diagram of a plan view of the rotor used in the example.

DESCRIPTION OF THE PREFERRED EMBODIMENT

Figure 1:
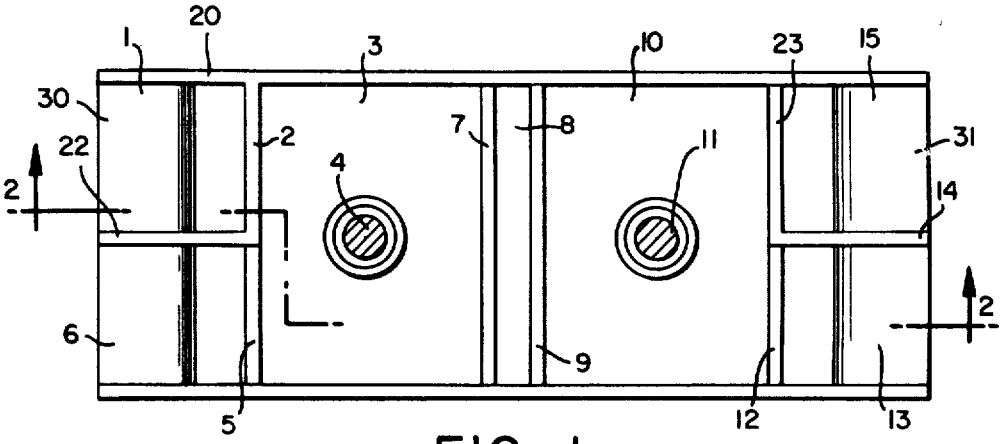
FIG. 1 is a schematic diagram of a plan view of an embodiment of subject apparatus.

The first step in achieving the defined improvement was to make a determination as to what limited the refining capacity of the known compact apparatus. It was found that one limitation was caused by the allowable head drop of the liquid metal in passing through the system. The "head drop" is the difference between the higher level at which the liquid metal enters the system at the inlet trough and the lower level at which the melt leaves the system at the exit trough. At the maximum capacity of 60,000 pounds per hour, this head drop is about 2 to about 3 inches. The configuration of the compact apparatus makes it difficult, if not impossible, to operate at or above maximum capacity with any larger head drop. The drop in metal level in the exit trough due to head drop results in higher flow velocities, which increase the chance of mixing floating dross with the refined metal stream. Further increases in exit flow velocities, resulting from higher metal flow rates, add to the chance of dross mixing. The higher metal flow rates also increase the fluid friction, primarily in the exit tube, which, in turn, results in additional head drop. Further, higher metal flow rates require higher speeds of rotation for the gas distributor and higher gas sparging (flow) rates to achieve the same degree of refining capacity and these rotating speeds and sparging rates also increase the head drop. Thus, part of the solution to the problem appeared to lie in finding a way to limit the head drop and, in so doing, overcome any negative factors arising therefrom.

The refining capacity of the known compact apparatus is also limited by the fact that there is a considerable amount of mixing of the melt from the second refining compartment back into the first refining compartment. The rate at which one rotating gas distributing device will remove particulates at fixed operating conditions, i.e., rotating speed, gas flow, nozzle and compartment dimensions, etc., is proportional to the concentration of particulates present. The rate of hydrogen removal under the same conditions is proportional to the square of the hydrogen content. Under these circumstances, the refining capacity of a system of two or more rotating gas distributors is obtained when each distributor is in a separate refining compartment and arranged so that liquid flow is in only one direction. That is, if the intended flow pattern is from the first compartment to the second compartment, as it is here, then, there should be essentially no flow back from the second compartment to the first compartment. This may be referred to as a "staging" effect, well known in many continuous flow-through operations.

Figure 2:
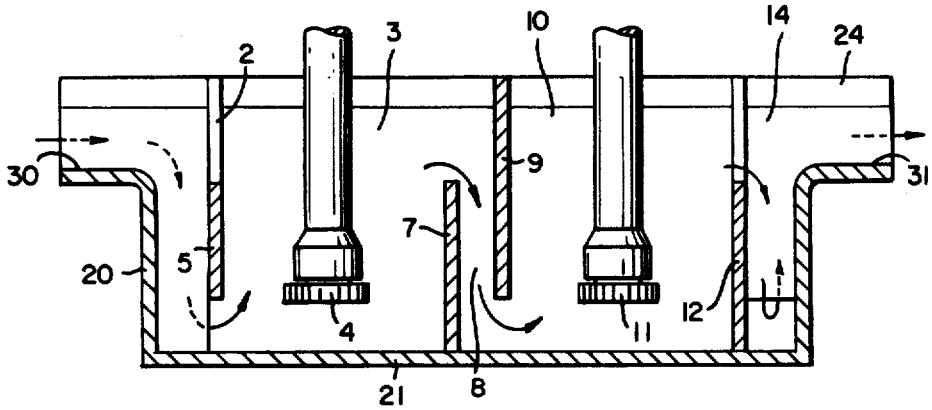
FIG. 2 is a schematic diagram of a side elevation of the same embodiment of subject apparatus taken along line 2—2 of FIG. 1.

Referring to the drawing:

FIGS. 1 and 2 show a vessel in the shape of a rectangular prism having four outer side walls 20 and a bottom wall 21 with interior walls 22 and 23 and baffles separating the six distinct compartments. Typically, the outer side walls 20 and the bottom wall 21 can be made up of several layers, from the outside in, including refractory insulation, a chamber with heating elements, a cast iron shell, and graphite plates lining the part of the vessel, which is not exposed to air, and silicon carbide plates lining the balance. These layers are conventional and are not shown in the drawings. Typical refining vessels would also have a cover 24 to assist in preserving the closed system. The baffles or baffle plates are preferably graphite or silicon carbide. In relation to the path of the melt, the inlet zone comprises inlet compartment 1, which includes lip 30 and baffle 2, and the outlet zone comprises baffle 12, dross removal compartment 13, baffle 14, and outlet compartment 15, which includes lip 31.

The flow of the melt is represented by arrows.

The molten metal enters at inlet compartment 1 over lip 30 and passes under baffle 2 into refining compartment 3, baffle 2 being constructed so that the molten metal cannot pass except as stated. In refining compartment 3, the molten metal meets rotating gas distributor 4 and refining proceeds as described above. Dross accumulates on the top of the melt and is floated on the surface of the melt over the top of baffle 5 into dross removal compartment 6 where it is skimmed off, and the remaining molten metal passes under baffle 5 and is recycled to refining compartment 3. It will be observed that inlet compartment 1 and dross removal compartment 6 are completely separated from each other meltwise. The molten metal then passes over the top of baffle 7 into space 8 located between baffle 7 and baffle 9, and under baffle 9 into refining compartment 10 where it is contacted by rotating gas distributor 11 and is further refined.

The melt with dross floating on its surface proceeds from refining compartment 10 over baffle 12 into the top section of dross removal compartment 13. The dross is skimmed off and removed here and the melt passes beneath baffle 14 into outlet compartment 15 where it passes over lip 31 and out of the system to a conventional use point (not shown). It should be noted that outlet compartment 15 does not connect directly with refining compartment 10 insofar as the movement of melt is concerned.

The tops of baffles 5, 7, and 12 are preferably made as high as possible, consistent with being able to skim off the dross layer and clean the walls of refining compartments 3 and 10. In normal use, when the system is in an idle condition, i.e., not refining, the liquid level is reduced to a level at or above lip 30 of inlet compartment 1 or lip 31 of outlet compartment 15, whichever is lower. This may be referred to as the idle level of the apparatus. The tops of baffles 5, 7, and 12 are located slightly below this level, e.g., about 1.5 inches, so that they do not obstruct the free movement of dross from the refining compartments toward the dross removal compartments. The distance between the bottoms of baffles 5, 9, and 14 and the floor of the vessel (21) is just enough to give relatively unstrained liquid flow, e.g., about six inches in a typical construction.

The distance between baffles 7 and 9, i.e., the width of space 8, is again, based on operator experience, but, as a rule of thumb, is about one half of the distance from the floor of the vessel (21) to the bottom of baffle 9. Baffle 9 usually extends to the top of the vessel, as well as baffles 2 and 14, and the common walls 22 and 23 between inlet compartment 1 and dross removal compartment 6 and outlet compartment 15 and refining compartment 10, respectively.

It is found that subject apparatus can not only be used to increase the flow rate of the melt through the system by at least about one hundred percent, but can be used to provide a greater degree of refining by increasing the rotating speed of the spinning nozzles and the gas flows at the conventional and increased flow rates. Further, any number of combinations of flow rate, speed of rotation, and gas flow are possible because the head drop is essentially eliminated, i.e., below one inch.

Where the apparatus is built with three or more refining compartments, side or top access to the refining compartments intermediate of the first and last refining compartments in the series is provided for dross removal and clean-out. The intermediate compartments are essentially of the same construction as refining compartments 3 and 10 except that a baffle combination, such as baffles 7 and 9, will be located on each of the upstream and the downstream sides of the compartment. Thus, the inlet to each refining compartment in the series is near the bottom and the outlet is near the top.

The following example illustrates the invention:

EXAMPLE

The apparatus described above and in the drawing is constructed according to the following dimensions:

(i) rotor (see FIG. 5) is 7.5 inches in diameter and 2 7/16 inches thick; periphery is notched to form 8 vanes 35, each 1 inch wide by 1.25 inches long;

(ii) rotor position: bottom of rotor is 5 inches from bottom of refining compartment;

(iii) two refining compartments, each23 inches wide by 29 inches long;

(iv) liquid depth in each refining compartments during refining as 29 inches;

(v) inlet compartment is 4 inches wide by 11 inches long;

(vi) outlet compartment is 6 inches wide by 11 inches long;

(vii) opening below baffles 2, 9, and 14 is 6 inches high; and (viii) space between baffles 7 and 9 is 3 inches.

The apparatus is operated as a water model under the following conditions:

(i) flow rate is the water volume equivalent of a liquid aluminum flow rate of 120,000 pounds per hour;

(ii) rotor speed is 550 revolutions per minute;

(iii) gas (nitrogen) flow to each rotor is the simulated equivalent of 6 cubic feet per minute (CFM) of argon or nitrogen (actual flow is 18 CFM to compensate for the 3 to 1 volume expansion of process gas heated to liquid aluminum temperature); and (iv) water entering the apparatus contains dissolved oxygen in the amount of about 6 to about 8 parts per million (ppm). The sparging action of the rotating gas distributor removes a portion of the dissolved oxygen simulating the action in molten metal of removing non-metallic impurities and hydrogen. The oxygen content of the inlet and outlet streams are measured.

Results (i) the liquid level in the outlet compartment is approximately the same as the liquid level in the inlet compartment. The relative levels could be changed by varying the speed of rotation of the rotor and the gas flow. Increasing the gas flow in this example increases the liquid level in the outlet compartment relative to the level in the inlet compartment. Increasing the rotor speed has the opposite effect. It is a simple matter in practice to vary rotor speeds and gas flows to obtain level flow or to obtain an outlet level a little higher or lower than the inlet level, if desired; and (ii) the simulated degree of refining (as measured by the oxygen removal from the water) is the same as in the two nozzle compact system when it is operated at its maximum refining rate with a water volume flow rate equivalent to a liquid aluminum flow rate of 60,000 pounds per hour.

I claim:

1. In an apparatus for refining molten metal comprising, in combination:

(a) a vessel having an inlet zone and an outlet zone; at least two refining compartments in between, connected in series, separated by baffles, and positioned in such a manner that the first refining compartment in the series is adjacent and connected to the inlet zone and the last refining compartment in the series is adjacent and connected to the outlet zone; and dross removal means; and (b) one rotating gas distributing device disposed at about the center of each refining compartment, said device comprising a shaft having drive means at its upper end and a rotor fixedly attached to its lower end, the upper end being positioned in the top section of the compartment and the lower end being positioned in the bottom section of the compartment, the improvement comprising:

(1) positioning the inlet zone and the outlet zone in such a manner that the molten metal is permitted to flow from the bottom of the inlet zone to the bottom section of the first refining compartment in the series and from the top section of the last refining compartment in the series to the top of the outlet zone; and (2) utilizing for each separating baffle, a baffle consisting of first and second baffles bearing a spaced relationship to one another and positioned in such a manner that (i) the first baffle is on the inlet side of the vessel and the second baffle is on the outlet side of the vessel and (ii) molten metal is permitted to flow from the top section of one refining compartment over the top of the first baffle into the space between the first and second baffles and under the second baffle into the bottom section of the next refining compartment in the series.

2. The apparatus defined in claim 1 wherein the inlet zone comprises an inlet compartment and a dross removal compartment having a baffle (i) separating the inlet compartment from the first refining compartment and being positioned in such a manner that molten metal is permitted to flow from the bottom section of the inlet compartment to the bottom section of the first refining compartment, and a baffle (ii) separating the first refining compartment from the dross removal compartment and being positioned in such a manner that the molten metal is permitted to flow from the top section of the first refining compartment into the top section of the dross removal compartment and from the bottom section of the dross removal compartment into the bottom section of the first refining compartment.

3. The apparatus defined in claim 1 wherein the outlet zone comprises an outlet compartment and a dross removal compartment having a baffle (iii) separating the last refining compartment from the dross removal compartment and being positioned in such a manner that molten metal is permitted to flow from the top section of the last refining compartment into the top section of the dross removal compartment, and a baffle (iv) separating the dross removal compartment from the outlet compartment and being positioned in such a manner that molten metal is permitted to flow from the bottom section of the dross removal compartment into the bottom section of the outlet compartment.

4. The apparatus defined in claim 1 wherein the first baffle is positioned so that its top is just below the idle level of the apparatus.

5. In an apparatus for refining molten metal comprising, in combination:

(a) a vessel having six compartments: an inlet compartment, a first dross removal compartment, a first refining compartment, a second refining compartment, an outlet compartment, and a second dross removal compartment wherein the following baffles, which permit the face of metal from one compartment to another, are present as follows: baffle (i) separating the inlet compartment from the first refining compartment; baffle (ii) separating the first refining compartment from the second refining compartment; baffle (iii) separating the second refining compartment from the second dross removal compartment; baffle (iv) separating the second dross removal compartment from the outlet compartment; and baffle (v) separating the first refining compartment from the first dross removal compartment; and (b) one rotating gas distributing device disposed at about the center of each refining compartment, said device comprising a shaft having drive means at its upper end and a rotor fixedly attached to its lower end, the upper end being positioned in the top section of the compartment and the lower end being positioned in the bottom section of the compartment, the improvement comprising positioning the baffles as follows:

baffle (i) is positioned in such a manner that molten metal is permitted to flow from the bottom section of the inlet compartment to the bottom section of the first refining compartment;

baffle (ii) comprises first and second baffles, bearing a spaced relationship to one another, positioned in such a manner that molten metal is permitted to flow from the top section of the first refining compartment over the top of the first baffle into the space between the first and second baffles and under the second baffle into the bottom section of the second refining compartment;

baffle (iii) is positioned in such a manner that molten metal is permitted to flow from the top section of the second refining compartment to the top section of the second dross removal compartment;

baffle (iv) is positioned in such a manner that molten metal is permitted to flow from the bottom section of the second dross removal compartment to the bottom section of the outlet compartment; and baffle (v) is positioned in such a manner that the molten metal is permitted to flow from the top section of the first refining compartment into the top section of the first dross removal compartment and from the bottom section of the first dross removal compartment to the bottom section of the first refining compartment.

6. The apparatus defined in claim 5 wherein the first baffle of baffle (ii), baffle (iii), and baffle (v) are positioned so that their tops are just below the idle level of the apparatus.

* * * * *